United States Patent [19]

Sirek

[11] Patent Number: 4,974,752

[45] Date of Patent: Dec. 4, 1990

[54] HEATED CAULK DISPENSING GUN

[76] Inventor: Andrew J. Sirek, 4827 N. Orchid La., Plymouth, Minn. 55446

[21] Appl. No.: 441,286

[22] Filed: Nov. 27, 1989

[51] Int. Cl.[5] ..... B67D 5/62

[52] U.S. Cl. ..... 222/146.5; 222/327; 222/391

[58] Field of Search ..... 222/146.5, 326, 327, 222/391

[56] References Cited

U.S. PATENT DOCUMENTS

| | | | |
|---|---|---|---|
| 1,555,711 | 9/1925 | Hershinger | 222/327 |
| 1,709,445 | 4/1929 | Tomes | 222/327 X |
| 2,617,560 | 11/1952 | Pietrzak | 222/391 X |
| 2,742,142 | 4/1956 | Paulsen . | |
| 2,884,877 | 5/1959 | Nalbone et al. | 222/391 |
| 3,069,053 | 12/1962 | Nilsson | 222/391 |
| 3,321,108 | 5/1967 | Bowe | 222/391 X |
| 3,459,335 | 8/1969 | Cohen et al. . | |
| 3,744,921 | 7/1973 | Weller et al. | 222/146.5 X |
| 3,767,085 | 10/1973 | Cannon et al. | 222/327 X |
| 4,033,484 | 7/1977 | Ornsteen | 222/146.5 |
| 4,065,034 | 12/1977 | Callan | 222/146.5 |
| 4,067,481 | 1/1978 | Feldman | 222/146.5 |
| 4,358,030 | 11/1982 | Leibhard et al. . | |
| 4,639,155 | 1/1987 | Schuster et al. . | |
| 4,681,524 | 7/1987 | Ikeda et al. | 222/391 X |
| 4,795,064 | 1/1989 | Sheu . | |

FOREIGN PATENT DOCUMENTS

| | | | |
|---|---|---|---|
| 2076473 | 12/1981 | United Kingdom | 222/391 |

*Primary Examiner*—Kevin P. Shaver

*Attorney, Agent, or Firm*—Jerry T. Kearns

[57] ABSTRACT

A heated caulk dispensing gun for dispensing sealant from conventional cylindrical refill cartridges in cold ambient temperature conditions includes an elongated semi-cylindrical base having a mating semi-cylindrical cover mounted for pivotal movement by a hinge. A ratchet mechanism actuates a plunger rod for incrementally dispensing contents from a refill cartridge upon manual activation of a pivotal trigger lever. An electrical resistance heating element lines the base and cover and is connected to a thermostatic control for maintaining a predetermined temperature level. A power cord is connected to the heating element for providing power from an external source.

2 Claims, 4 Drawing Sheets

HEATED CAULK DISPENSING GUN

BACKGROUND OF THE INVENTION

1. Field of the Invention

The present invention relates to heated dispensing guns, and more particularly pertains to a heated dispensing gun adapted for dispensing sealant from conventional cylindrical refill cartridges under cold environmental conditions. Conventional building construction methods require the use of caulk type sealant dispensed from caulking guns. During winter months, the conventional caulk sealant material frequently becomes hardened and unusable. In order to overcome this problem, the present invention provides an electrically heated dispensing gun for maintaining a sealant material within a conventional disposable refill cartridge at an optimal temperature level for expedient application.

2. Description of the Prior Art

Various types of heated dispensing guns are known in the prior art. A typical example of such a heated dispensing gun is to be found in U.S. Pat. No. 2,742,142, which issued to H. Paulsen on Apr. 17, 1956. This patent discloses a portable tool for dispensing thermoplastic cement from a cement rod. U.S. Pat. No. 3,459,335, which issued to D. Cohen et al on Aug. 5, 1969, discloses a manual dispenser for applying thermoplastic adhesives including a melt chamber having a resistive heating element and a thermostatic control adapted for connected to an external power source by a power cord. U.S. Pat. No. 4,358,030, which issued to E. Leibhard et al on Nov. 9, 1982, discloses a dispensing gun for melting and dispensing a measured amount of a thermoplastic adhesive. A sealing sleeve conveys the solid thermoplastic adhesive into the inlet end of a melting chamber. U.S. Pat. No. 4,639,155, which issued to H. Schuster et al on Jan. 27, 1987, discloses a device for use in a hand held heated dispensing gun to prevent continued discharge of a melted composition from the outlet thereof, when the gun is not in use. U.S. Pat. No. 4,795,064, which issued to S. Sheu on Jan. 3, 1989, discloses a gas heated glue gun including a chamber having a self-contained supply of gas for heating glue. The gas is ignited by a spark caused by manual movement of a trigger.

While the above mentioned devices are directed to heated dispensing guns, none of these devices is capable of maintaining a conventional caulk type sealant at a predetermined optimal temperature level in cold ambient conditions. Inasmuch as the art is relatively crowded with respect to these various types of heated dispensing guns, it can be appreciated that there is a continuing need for and interest in improvements to such heated dispensing guns, and in this respect, the present invention addresses this need and interest.

SUMMARY OF THE INVENTION

In view of the foregoing disadvantages inherent in the known types of heated dispensing guns now present in the prior art, the present invention provides an improved heated caulk dispensing gun. As such, the general purpose of the present invention, which will be described subsequently in greater detail, is to provide a new and improved heated caulk dispensing gun which has all the advantages of the prior art heated dispensing guns and none of the disadvantages.

To attain this, a representative embodiment of the concepts of the present invention is illustrated in the drawings and makes use of a heated caulk dispensing gun for dispensing sealant from conventional cylindrical refill cartridges in cold ambient temperature conditions which includes an elongated semi-cylindrical base having a mating semi-cylindrical cover mounted for pivotal movement by a hinge. A ratchet mechanism actuates a plunger rod for incrementally dispensing contents from a refill cartridge upon manual activation of a pivotal trigger lever. An electrical resistance heating element lines the base and cover and is connected to a thermostatic control for maintaining a predetermined temperature level. A power cord is connected to the heating element for providing power from an external source.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved heated caulk dispensing gun which has all the advantages of the prior art heated dispensing guns and none of the disadvantages.

It is another object of the present invention to provide a new and improved heated caulk dispensing gun which may be easily and efficiently manufactured and marketed.

It is a further object of the present invention to provide a new and improved heated caulk dispensing gun which is of a durable and reliable construction.

An even further object of the present invention is to provide a new and improved heated caulk dispensing gun which is susceptible of a low cost of manufacture with regard to both materials and labor, and which accordingly is then susceptible of low prices of sale to the consuming public, thereby making such heated dispensing guns economically available to the buying public.

Still yet another object of the present invention is to provide a new and improved heated caulk dispensing gun which provides in the apparatuses and methods of the prior art some of the advantages thereof, while simultaneously overcoming some of the disadvantages normally associated therewith.

Still another object of the present invention is to provide a new and improved heated caulk dispensing gun adapted for use with conventional disposable cylindrical sealant refill cartridges.

Yet another object of the present invention is to provide a new and improved heated caulk dispensing gun for maintaining sealant material in a refill cartridge at a predetermined optimal temperature level during cold ambient temperature level conditions.

Even still another object of the present invention is to provide a new and improved heated caulk dispensing gun having an interior closable chamber including electrical resistance heating elements and a thermostatic control for maintaining a replaceable sealant cartridge at an optimal temperature level.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
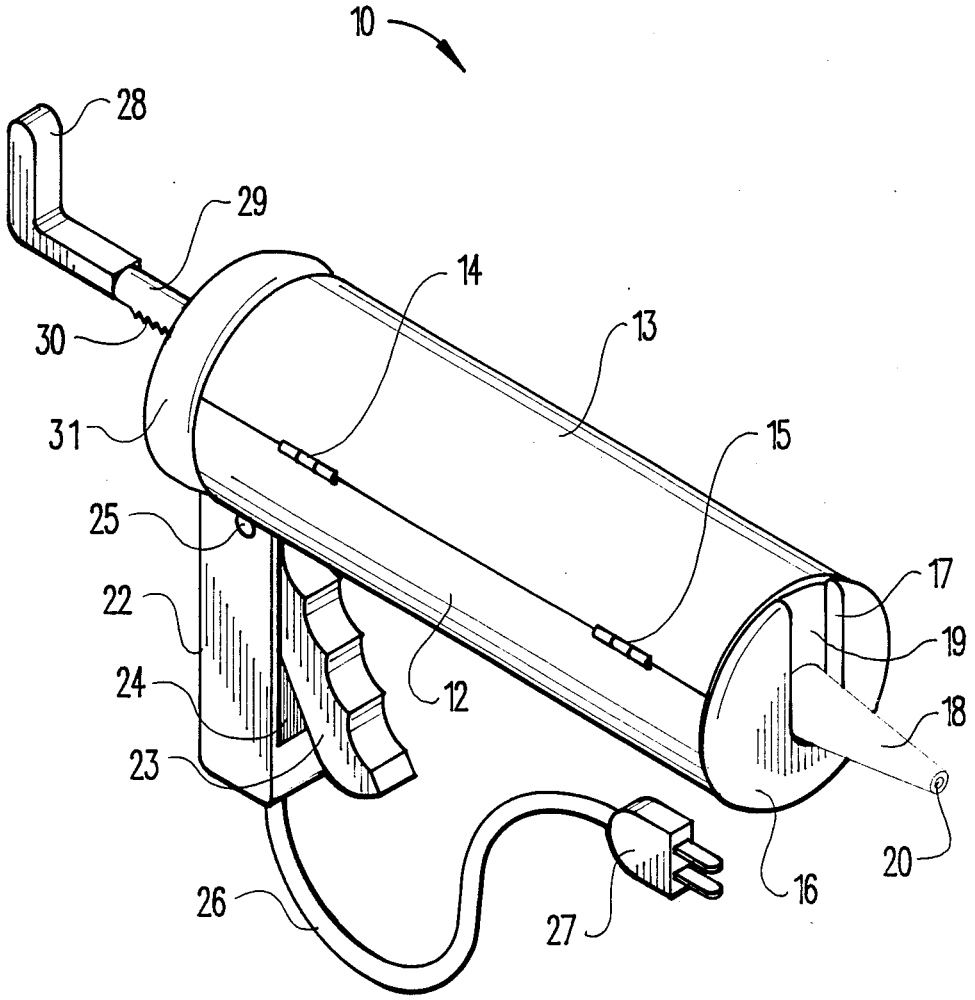
FIG. 1 is a front perspective view of the heated caulk dispensing gun according to the present invention.

With reference now to the drawings, and in particular to FIG. 1 thereof, a new and improved heated caulk dispensing gun embodying the principles and concepts of the present invention and generally designated by the reference numeral 10 will be described.

More specifically, it will be noted that the first embodiment 10 of the invention includes an elongated semi-cylindrical base 12 and a mating semi-cylindrical cover 13. The cover 13 is secured by a plurality of spaced hinges 14 and 15 for movement between open and the illustrated closed positions. A cylindrical front end cap is secured on a front end portion of the base 12 and includes a radial slot 17 dimensioned for insertion of the nozzle 18 of a conventional refill sealant cartridge 19. The nozzle 18 is of the type having a dispensing opening 20 which is initially sealed and is opened by cutting a small tip portion to form a desired tip configuration. A stationary handle frame 22 is secured at a rear end portion of the base 12 and includes a rear end cover portion 31. An actuating plunger rod 29 extends through a passage formed in the cover 31 and includes a transverse handle portion 28. A plurality of spaced ratchet teeth 30 are formed along a bottom surface of the rod 29. A trigger lever 23 is pivotally mounted through a longitudinal opening 24 in the handle frame 22. A pivot pin 25 extends through the trigger lever 23. A power cord 26 is connected to an internal electrical resistance heating element which lines the base 12 and cover 13. The power cord 26 includes a plug 27 adapted for engagement with a conventional AC electrical outlet.

Figure 2:
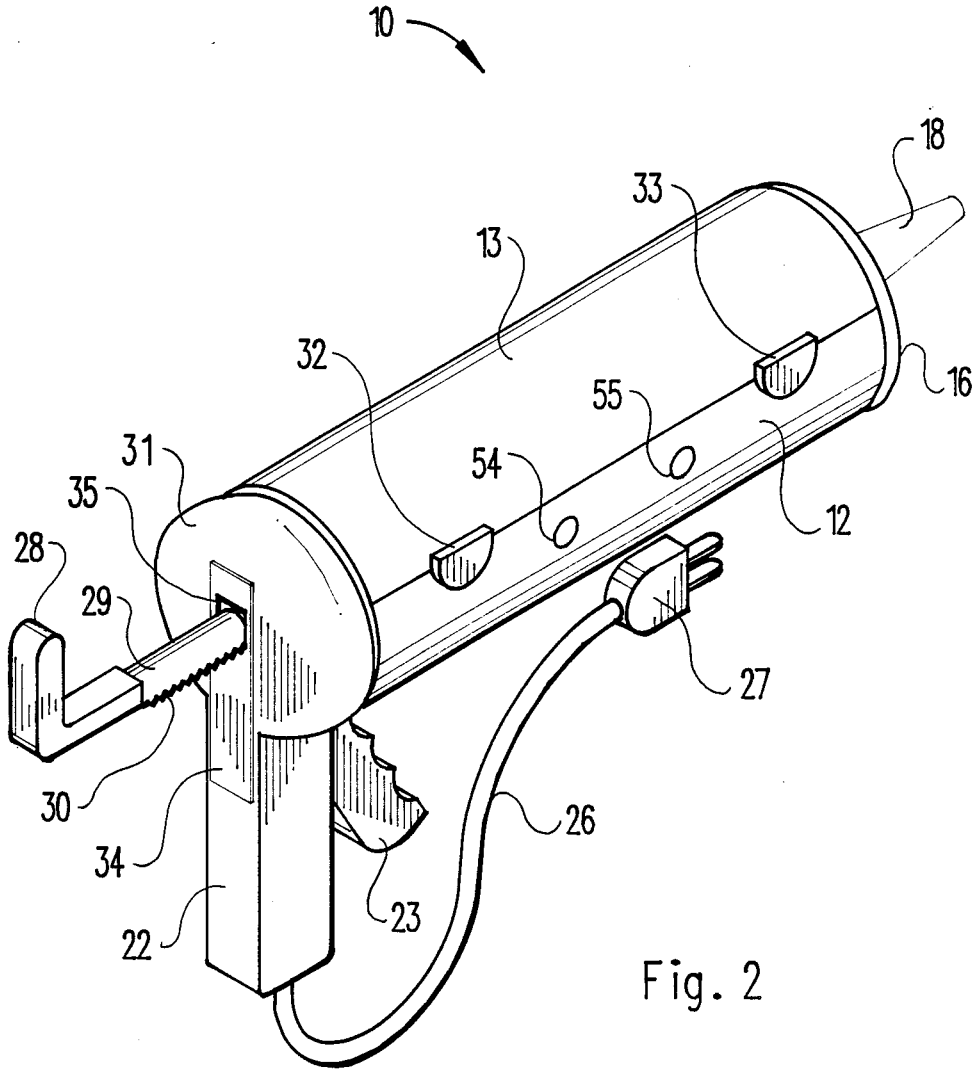
FIG. 2 is a rear perspective view of the heated caulk dispensing gun of FIG. 1.

As shown in FIG. 2, a pair of spaced latches 32 and 33 are provided on the base 12 for securing the cover 13 in the illustrated closed positions. The latches 32 and 33 may be formed from an elastic or resilient plastic or metal material and configured for engagement with cooperating locking projections or recesses on the free edge portion of the cover 13. The rod 29 extends through a passage 35 formed through a locking bar 34 and through the cover portion 31 of the handle frame 22. A pair of indicating lights 54 and 55 may be provided on the base 12 and connected to an internal thermostatic control unit for indicating a power on condition of the heating element, and the achievement of a predetermined optimal temperature level.

Figure 3:
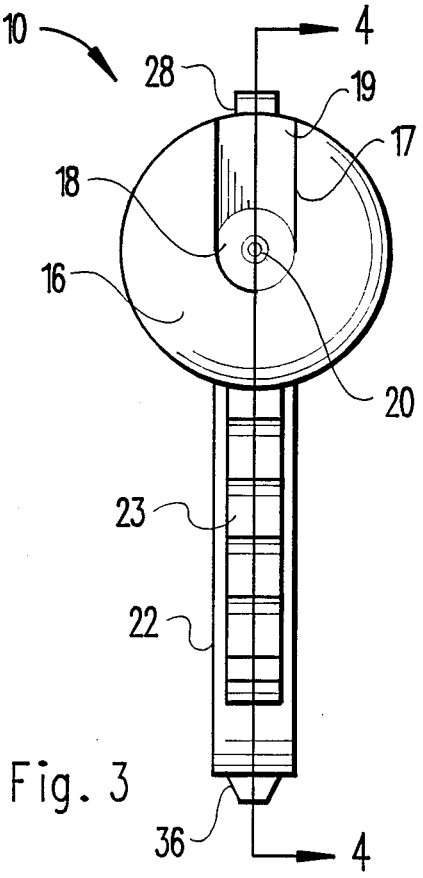
FIG. 3 is a front end view of the caulk-dispensing gun of FIG. 1.

FIG. 3 is a front end view of the caulking gun 10, which illustrates a grommet 36 formed on a bottom end surface of the handle frame 22 and adapted for receiving the power cord 26 illustrated in FIG. 1.

Figure 4:
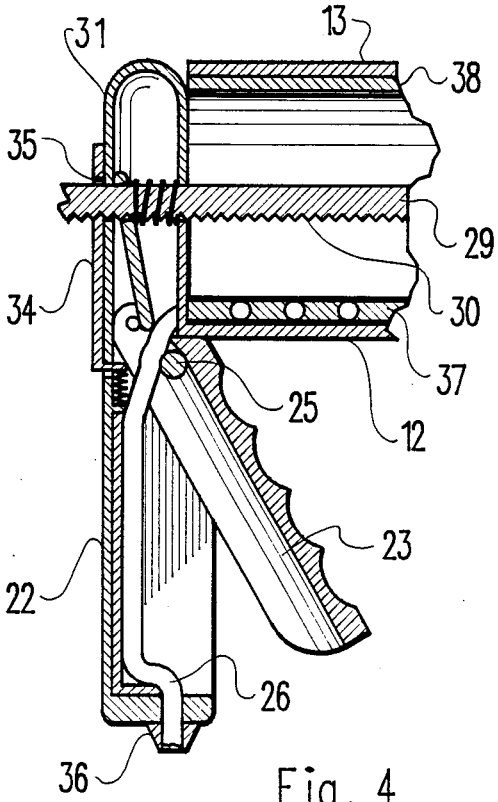
FIG. 4 is a partial longitudinal cross sectional view, taken along line 4—4 of FIG. 3.

As illustrated in FIG. 4, the electrical resistance heating element includes semi-cylindrical portions 37 and 38 which line the base 12 and cover 13. The elements 37 and 38 may be connected by suitable flexible electrical connection strips with a common thermostatic control unit.

Figure 5:
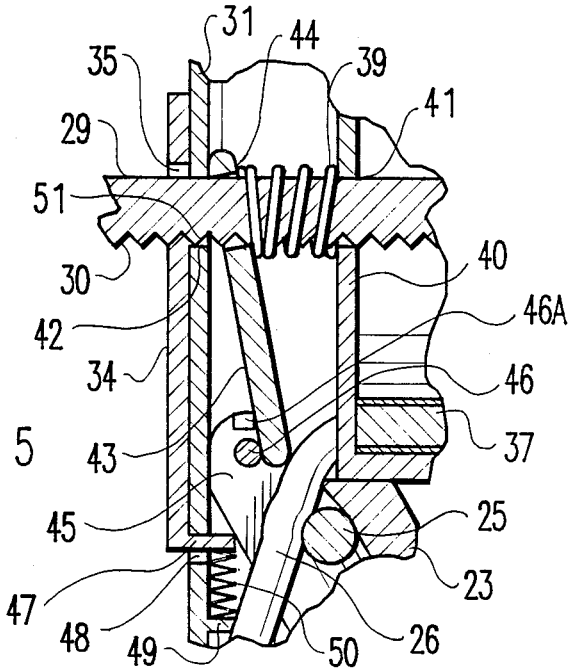
FIG. 5 is an enlarged cross sectional detail view, illustrating the construction of the activating plunger incremental advancing mechanism.

As shown in FIG. 5, the trigger lever 23 has an upper end portion 45 upon which a tab 43 is mounted for limited pivotal movement by a pivot pin 46. An abutment stop 46A on the trigger upper end portion 45 serves to limit rearward pivotal movement of the tab 43. The tab 43 has an aperture 44 through which the actuating rod 29 is received. A coil spring 39 surrounds the rod 29 and biases the tab 43 to the rear end portion 31 of the stationary handle frame. The coil spring has a forward end which abuts a stationary transverse wall 40 and is thus constrained against axial movement. The rod 29 is mounted for axial movement through apertures 35 and 41, and through the interior of the coil spring 39. The locking bar 34 is mounted for limited reciprocal axial movement in a direction transverse to the longitudinal axis of the rod 29. A right angle flange portion 47 of the locking bar 34 extends through an aperture 48 in the handle frame cover portion 31. A spring 50 is captured between a stationary flange 49 and the flange 47 of the locking bar 34. The locking bar 34 has a cam end portion dimensioned for engagement with the ratchet teeth on the rod 29. Thus, the spring 50 biases the locking bar 34 to the illustrated locked position. When it is desired to dispense sealant material from a conventional disposable refill cartridge within the interior of the gun, the trigger lever 23 is manually squeezed, while the locking bar 34 is moved downwardly by an individual's thumb. This allows a one-handed actuation of the gun. As the trigger 23 is squeezed, it pivots about the axis of the pivot pin 25, causing an arcuate forward movement of the tab 43 which engages the teeth 30 of the rod 29, thus moving the rod 29 forwardly, to the right as shown in FIG. 5, through the apertures 35, 42 and 41. At this point, the locking bar 34 is released, and the coil spring 50 causes the locking bar to move upwardly, to secure the rod 29 in the incrementally advanced position. Upon release of the trigger lever 23, the spring 39 returns the tab 43 and the trigger lever 23 to the original illustrated position. When it is desired to retract or rapidly advance the rod 29, the rod 29 may be rotated by manual manipulation of the handle portion 28 (FIG. 1), such that the ratchet teeth 30 are facing upwardly, out of engagement with the locking bar cam end portion 51.

Figure 6:
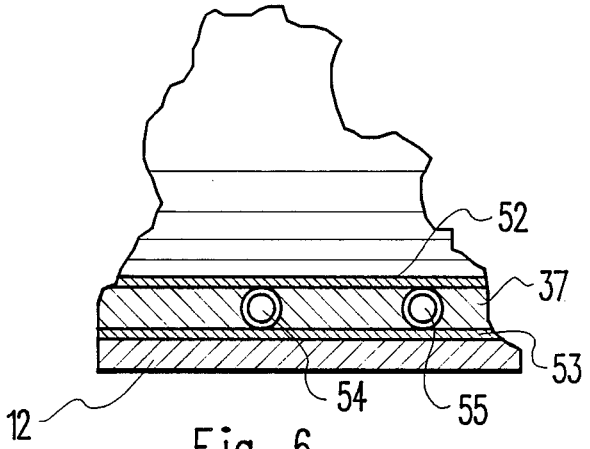
FIG. 6 is a cross sectional detail view, illustrating the electrical resistance heating element of the caulk dispensing gun.

FIG. 6 is a detail view which illustrates the electrical resistance heating element 37 which lines the semi-cylindrical base 12. The heating element 37 includes protective facing and backing layers 52 and 53 adapted for engagement with the interior surface of the base 12 and the exterior surface of a sealant refill cartridge. Indicating lights 54 and 55 extend from a conventional thermostatic control (not shown) through the side wall of the base 12, to allow observation by a user. The facing layer 52 is preferably formed from a high heat conductive material, for example copper or aluminum. It should that all electrical components will be insulated from the base 12, and other exposed components of the caulking gun, for the safety of a user.

Figure 7:
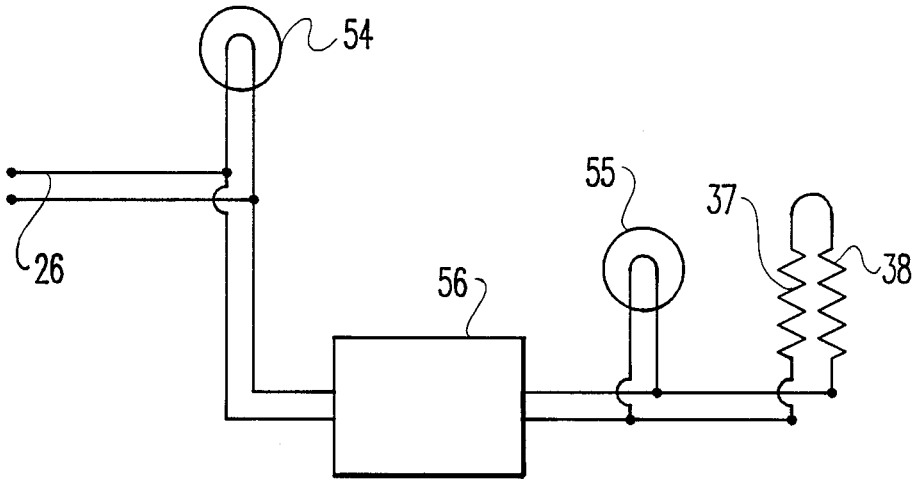
FIG. 7 is a schematic diagram illustrating the electrical components of the caulk dispensing gun of the present invention.

As shown in the schematic diagram of FIG. 7, the power cord 26 provides power to initially illuminate the indicating light 54, indicating a power on condition. It should be noted that a conventional switch may be provided in the power cord 26, to allow the heating element to be turned off, without unplugging the cord 26. A conventional thermostatic control unit 56, which may be of a solid state type, or may employ various conventional bimetallic contacts, is set to maintain a predetermined optimal temperature level of the electrical resistance heating elements 37 and 38. The controlling unit 56 is operative to shut off electrical current to the heating elements 37 and 38 and the indicating lamp when a predetermined temperature level has been achieved.

Thus, the present invention provides an improved thermostatically controlled electrically heated caulk dispensing gun which allows the efficient usage of conventional sealants in cold ambient temperature conditions.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A heated caulk dispensing gun, comprising:
an elongated semi-cylindrical base;
a mating semi-cylindrical cover;
a hinge pivotally securing said cover to said base;
a latch for securing said cover in a closed position on said base;
a circular front end cap on a front end portion of said base;
a radial slot in said front end cap dimensioned for insertion of a refill cartridge nozzle;
a stationary handle frame secured to and covering a rear end portion of said base;
a passage formed through said handle frame;
an actuating plunger rod extending through said passage;
a plurality of ratchet teeth spaced along said rod;
a trigger lever pivotally mounted on said handle frame;
an elongated tab pivotally secured by a pivot pin on an upper end of said trigger lever;
an upper end of said tab having an aperture through which said rod extends;
a coil spring surrounding said rod and biasing said tab toward said rear end portion;
said coil spring constrained against axial movement and said rod axially movable through said coil spring;
an abutment stop on said upper end of said trigger lever, above said pivot pin, for limiting pivotal movement of said tab in a direction toward said rear end portion, such that said tab is operative to engage said ratchet teeth on said rod and advance said rod axially upon manual activation of said trigger lever;
a locking bar mounted for limited reciprocal axial movement on an exterior rear face of said handle frame portion, said locking bar movable transversely to a longitudinal axis of said rod;
said locking bar having an aperture through which said rod extends;
said locking bar having a cam end portion bordering a bottom edge of said locking bar aperture dimensioned for engagement with said ratchet teeth on said rod;
said locking bar having a right angle flange portion extending through an elongated aperture in said exterior rear face of said handle frame portion;
a locking spring biasing said right angle flange portion of said locking bar into engagement with said ratchet teeth;
an electrical resistance heating element lining said base and cover;
a power cord for connecting said heating element to an external power source; and
a thermostatic control connected to said heating element to maintain a predetermined temperature level.

2. A heated caulk dispensing gun, comprising:
an elongated base;

a mating cover;
a hinge pivotally securing said cover to said base;
a latch for securing said cover in a closed position on said base;
a stationary handle frame secured to and covering a rear end portion of said base;
a passage formed through said handle frame;
an actuating plunger rod extending through said passage;
a plurality of ratchet teeth spaced along said rod;
a trigger lever pivotally mounted on said handle frame;
an elongated tab pivotally secured by a pivot pin on an upper end of said trigger lever;
an upper end of said tab having an aperture through which said rod extends;
a coil spring surrounding said rod and biasing said tab toward said rear end portion;
said coil spring constrained against axial movement and said rod axially movable through said coil spring;
an abutment stop on said upper end of said trigger lever, above said pivot pin, for limiting pivotal movement of said tab in a direction toward said rear end portion, such that said tab is operative to engage said ratchet teeth on said rod and advance said rod axially upon manual activation of said trigger lever;
a locking bar mounted for limited reciprocal axial movement on an exterior rear face of said handle frame portion, said locking bar movable transversely to a longitudinal axis of said rod;
said locking bar having an aperture through which said rod extends;
said locking bar having a cam end portion bordering a bottom edge of said locking bar aperture dimensioned for engagement with said ratchet teeth on said rod;
said locking bar having a right angle flange portion extending through an elongated aperture in said exterior rear face of said handle frame portion;
a locking spring biasing said right angle flange portion of said locking bar into engagement with said ratchet teeth;
an electrical resistance heating element lining said base and cover;
and
a power cord for connecting said heating element to an external power source.

* * * * *